US009505118B2

(12) United States Patent
Furusawa et al.

(10) Patent No.: US 9,505,118 B2
(45) Date of Patent: Nov. 29, 2016

(54) STRIKING TOOL

(75) Inventors: Masanori Furusawa, Anjo (JP); Yoshihiro Kasuya, Anjo (JP); Hajime Takeuchi, Anjo (JP)

(73) Assignee: MAKITA CORPORATION, Anjo-Shi (JP)

( * ) Notice: Subject to any disclaimer, the term of this patent is extended or adjusted under 35 U.S.C. 154(b) by 808 days.

(21) Appl. No.: 13/263,027

(22) PCT Filed: Apr. 9, 2010

(86) PCT No.: PCT/JP2010/056459
§ 371 (c)(1),
(2), (4) Date: Nov. 7, 2011

(87) PCT Pub. No.: WO2010/117063
PCT Pub. Date: Oct. 14, 2010

(65) Prior Publication Data

US 2012/0067605 A1 Mar. 22, 2012

(30) Foreign Application Priority Data

Apr. 10, 2009 (JP) ..... 2009-096498

(51) Int. Cl.
*B25D 17/24* (2006.01)
*B25D 17/04* (2006.01)

(52) U.S. Cl.
CPC ..... *B25D 17/24* (2013.01); *B25D 17/043* (2013.01); *B25D 2211/003* (2013.01); *B25D 2222/57* (2013.01); *B25D 2250/121* (2013.01); *B25D 2250/371* (2013.01)

(58) Field of Classification Search
CPC .. B25D 17/24; B25D 17/043; B25D 17/046; B25D 17/00
USPC ..... 173/162.1, 162.2, 210
See application file for complete search history.

(56) References Cited

U.S. PATENT DOCUMENTS 3,845,827 A * 11/1974 Schulin ..... 173/162.1
3,921,729 A * 11/1975 Schmuck ..... B25D 11/005 173/104

(Continued)

FOREIGN PATENT DOCUMENTS

CN 1637314 A 7/2005
CN 101088709 A 12/2007

(Continued)

OTHER PUBLICATIONS

Office Action issued in Chinese Patent Application No. 201080016227.5 dated Oct. 9, 2013.

(Continued)

*Primary Examiner* — Hemant M Desai
*Assistant Examiner* — Eduardo R Ferrero
(74) *Attorney, Agent, or Firm* — Oliff PLC

(57) ABSTRACT

A technique for improving the vibration-proof effect and usability of a handle is provided in an impact tool. An impact tool is provided which linearly drives a tool bit in an axial direction thereof to cause the tool bit to perform a predetermined hammering operation. The impact tool includes a motor, a striking mechanism part, that is driven by the motor and causes the tool bit to linearly move, a tool body that houses the motor and the striking mechanism part, an outer shell housing that covers at least part of the tool body and is connected to the tool body via a vibration-proofing first elastic element so as to be movable in a direction transverse to the axial direction of the tool bit with respect to the tool body, and a handle which is designed to be held by a user and connected to an opposite side of the outer shell housing from the tool bit via a vibration-proofing second elastic element so as to be movable in the axial direction of the tool bit with respect to the outer shell housing.

9 Claims, 14 Drawing Sheets

(56) References Cited

U.S. PATENT DOCUMENTS 4,066,136 A * 1/1978 Wanner ..... B25D 16/00 173/201
5,025,870 A * 6/1991 Gantner ..... 173/162.2
5,678,641 A 10/1997 Manschitz et al.
5,692,574 A * 12/1997 Terada ..... 173/162.2
6,561,285 B2 * 5/2003 Intonen ..... E02F 3/966 173/210
6,669,206 B2 * 12/2003 Hanke ..... B25D 17/06 279/19.4
6,805,207 B2 * 10/2004 Hagan et al. ..... 173/170
6,907,943 B2 * 6/2005 Ikuta ..... 173/117
6,948,571 B2 * 9/2005 Hanke et al. ..... 173/201
7,096,973 B2 * 8/2006 Ikuta et al. ..... 173/201
7,322,427 B2 * 1/2008 Shimma ..... B25D 16/006 173/170
7,469,752 B2 * 12/2008 Furusawa ..... B25D 16/006 173/170
7,673,703 B2 * 3/2010 Fischer et al. ..... 173/217
7,712,548 B2 * 5/2010 Moessnang ..... B25D 17/06 173/162.1
7,806,201 B2 * 10/2010 Aoki ..... B23D 51/16 173/162.2
7,832,498 B2 * 11/2010 Sugiyama ..... B25D 11/125 173/100
7,967,078 B2 * 6/2011 Aoki ..... B25D 17/24 173/109
7,967,079 B2 * 6/2011 Stierle et al. ..... 173/216
8,006,778 B2 * 8/2011 Wiker et al. ..... 173/162.2
8,091,651 B2 * 1/2012 Kuhnle et al. ..... 173/162.2
8,678,104 B2 * 3/2014 Kuhnle ..... B25D 17/24 173/162.1
8,708,062 B2 * 4/2014 Lamprecht ..... 173/217
2003/0006051 A1 * 1/2003 Schmitzer et al. ..... 173/49
2004/0108123 A1 * 6/2004 Shibata ..... B25D 16/00 173/201
2004/0154813 A1 * 8/2004 Daubner et al. ..... 173/162.2
2005/0247464 A1 * 11/2005 Hellbach et al. ..... 173/162.2
2005/0269117 A1 * 12/2005 Sato ..... B25D 17/11 173/132
2006/0011365 A1 * 1/2006 Stirm et al. ..... 173/162.2
2006/0219418 A1 * 10/2006 Arakawa et al. ..... 173/162.2
2006/0289185 A1 * 12/2006 Hahn ..... B25D 17/24 173/210
2007/0017684 A1 * 1/2007 Stirm et al. ..... 173/109
2007/0034396 A1 * 2/2007 Berger et al. ..... 173/162.2
2007/0034397 A1 * 2/2007 Fischer et al. ..... 173/162.2
2007/0039749 A1 * 2/2007 Aoki ..... 173/201
2007/0277992 A1 * 12/2007 Fuenfer ..... B25D 17/24 173/210
2007/0289762 A1 12/2007 Kikukchi et al.
2007/0289763 A1 * 12/2007 Wiker et al. ..... 173/162.2
2007/0295522 A1 * 12/2007 Bohne et al. ..... 173/162.2
2008/0000664 A1 1/2008 Steinke
2008/0017395 A1 * 1/2008 Sato ..... 173/162.2
2008/0073095 A1 * 3/2008 Henriksson ..... B25D 17/24 173/162.2
2008/0099223 A1 * 5/2008 Stirm et al. ..... 173/201
2008/0164043 A1 * 7/2008 Henriksson et al. ..... 173/212
2008/0185163 A1 * 8/2008 Becht et al. ..... 173/162.2
2008/0202785 A1 * 8/2008 Fischer et al. ..... 173/162.2
2008/0283261 A1 * 11/2008 Schmid et al. ..... 173/162.2
2008/0283264 A1 * 11/2008 Ikuta et al. ..... 173/211
2010/0139940 A1 * 6/2010 Kobayashi ..... 173/162.2
2010/0155095 A1 * 6/2010 Furusawa ..... B23Q 11/0046 173/198
2011/0290517 A1 * 12/2011 Takeuchi ..... B25D 17/00 173/90
2012/0067605 A1 * 3/2012 Furusawa et al. ..... 173/162.2

FOREIGN PATENT DOCUMENTS

CN 100464955 C 3/2009
CN 1915606 B 5/2010
EP 1 604 785 A2 12/2005
GB 2 154 497 A 9/1985
GB 2154497 A * 9/1985
GB 2 409 835 A 7/2005
JP A-56-69087 6/1981
JP U-2-82476 6/1990
JP B2-3520130 4/2004
JP A-2008-194821 8/2008
JP A-2009-513366 4/2009
JP WO 2009123267 * 10/2009
WO WO 2004/082897 A1 9/2004
WO WO 2007/039356 A1 4/2007

OTHER PUBLICATIONS

Search Report issued in International Application No. PCT/JP2010/056459 dated Jul. 13, 2010 (with translation).
Extended Search Report issued in European Patent Application No. 10761762.3 dated May 23, 2014.
Office Action issued in Russian Patent Application No. 2011145571 dated Apr. 11, 2014 (with translation).
Office Action issued in Chinese Patent Application No. 201080016227.5 dated Mar. 20, 2014.
Office Action issued in Japanese Patent Application No. 2009-096498 dated Jun. 11, 2013.
International Preliminary Report on Patentability issued in International Application No. PCT/JP2010/056459 dated Oct. 11, 2011 (w/translation).
Sep. 9, 2014 Office Action issued in Chinese Application No. 201080016227.5 (with translation).

* cited by examiner

STRIKING TOOL

FIELD OF THE INVENTION

The present invention relates to a vibration-proofing technique in a striking impact tool.

BACKGROUND OF THE INVENTION

Japanese Patent No. 3520130 discloses an electric hammer in which a housing integrally provided with a handle is connected to a striking mechanism part for striking a hammer bit, via an elastic element.

During operation using an electric hammer, vibration is caused in a striking mechanism part of the hammer not only in an axial direction of a tool bit in which the tool bit performs striking movement, but also in a direction transverse to the axial direction. Therefore, a technique is desired which can prevent vibration in various directions.

DISCLOSURE OF THE INVENTION

Object to be Achieved by the Invention

Accordingly, it is an object of the present invention to provide an impact tool in which the vibration-proof effect and usability of a handle are further improved.

Means for Achieving the Object

In order to achieve the above-described object, according to a preferred embodiment of the present invention, an impact tool is provided which linearly drives a tool bit in an axial direction of the tool bit to cause the tool bit to perform a predetermined hammering operation. The "impact tool" in this invention is not limited to a hammer in which a tool bit is caused to linearly move in the axial direction, and also suitably includes a hammer drill in which a tool bit is caused to linearly move in the axial direction and rotate around its axis.

The impact tool according to this invention is characterized in that it includes a motor, a striking mechanism part which is driven by the motor and causes the tool bit to linearly move, a tool body which houses the motor and the striking mechanism part, an outer shell housing which covers at least part of the tool body, a first elastic element which elastically connects the outer shell housing to the tool body such that the outer shell housing can move in a direction transverse to the axial direction of the tool bit with respect to the tool body, a handle designed to be held by a user, and a second elastic element which connects the handle to the outer shell housing such that the handle can move in the axial direction of the tool bit with respect to the tool body.

The "striking mechanism part" in this invention typically includes a motion converting mechanism which converts torque of the motor into linear motion, and a striker which is linearly driven via pressure fluctuations (air spring action) caused by this linear motion and strikes the tool bit. Further, the "first elastic element" and the "second elastic element" in this invention represent a spring or rubber.

According to this invention, as for vibration caused in the tool body that houses the striking mechanism part which is a vibrating source, vibration in the axial direction (the striking direction) of the tool bit is reduced by the second elastic element which connects the outer shell housing and the handle, while vibration in a direction transverse to the axial direction is reduced by the first elastic element which connects the tool body and the outer shell housing. Thus, by individually setting stiffness (spring constant) of the first and second elastic elements, the handle is made proof against vibration not only in the axial direction but also in a direction transverse to the axial direction. Furthermore, the handle can be prevented from wobbling in a direction transverse to the axial direction. Thus, usability of the handle can be improved.

According to a further embodiment of the impact tool of the present invention, the handle has a grip region extending in a direction transverse to the axial direction of the tool bit and one end of the grip region in an extending direction is connected to the outer shell housing by the second elastic element comprising a mechanical spring. In the case of an impact tool, the user holds the handle and performs an operation while applying a pressing force to the handle in a direction to press the tool bit against a workpiece. Therefore, by provision of the construction like in the present invention in which the grip region of the handle extends in a direction transverse to the axial direction of the tool bit, the operation of pressing the tool bit can be easily performed.

According to a further embodiment of the impact tool of the present invention, the outer shell housing is split into a plurality of split elements in the axial direction of the tool bit and formed by connecting the split elements to each other. According to this invention, when a plurality of split elements are clamped and connected together, for example, by screws, the split elements can be easily assembled together, with the first elastic element held between the outer shell housing and the tool body, so that ease of assembling the split elements is improved.

According to a further embodiment of the impact tool of the present invention, the tool body has a cylindrical barrel extending in the axial direction of the tool bit. Further, an O-ring is disposed between an outer circumferential surface of the barrel and an inner circumferential surface of the outer shell housing which covers the barrel, and the tool body and the outer shell housing are positioned in a radial direction by the O-ring. Further, the "radial direction" in this invention refers to a direction transverse to the axial direction of the tool bit.

According to this invention, the O-ring can serve as the first elastic element which connects the outer shell housing to the tool body.

In order to solve the above-described problem, according to a different embodiment of the present invention, an impact tool is provided which linearly drives a tool bit in an axial direction thereof to cause the tool bit to perform a predetermined hammering operation. Further, the "impact tool" in this invention is not limited to a hammer in which a tool bit is caused to linearly move in the axial direction; and also suitably includes a hammer drill in which a tool bit is caused to linearly move in the axial direction and rotate around its axis.

The impact tool according to this invention is characterized in that it includes a motor, a striking mechanism part which is driven by the motor and causes the tool bit to linearly move, a tool body which houses the motor and the striking mechanism part, an outer shell housing which covers at least part of the tool body, and a handle which is designed to be held by a user and integrally formed on an opposite side of the outer shell housing from the tool bit. The outer shell housing is connected to the tool body via at least a first elastic element which can elastically deform in a direction transverse to the axial direction of the tool bit and a second elastic element which can elastically deform in the axial direction of the tool bit. Further, the "striking mechanism part" in this invention typically includes a motion converting mechanism which converts torque of the motor into linear motion, and a striker which is linearly driven via pressure fluctuations (air spring action) caused by the linear motion of the motion converting mechanism and strikes the tool bit. The manner of "being integrally formed" in this invention suitably includes the manner in which the outer shell housing and the handle are integrally formed with each other or the manner in which the outer shell housing and the handle are separately formed and thereafter fixed to each other. Further, the "first elastic element" and the "second elastic element" in this invention represent a spring or rubber.

According to this invention, when the user holds the handle of the impact tool and performs an operation, as for vibration which is caused in the striking mechanism part and transmitted to the outer shell housing, vibration in the axial direction of the tool bit is prevented by the second elastic element, while vibration in a direction transverse to the axial direction of the tool bit is prevented by the first elastic element. Therefore, by individually setting stiffness (spring constant) of the first and second elastic elements, the handle is made proof against vibration not only in the axial direction but also in a direction transverse to the axial direction. Furthermore, the handle can be prevented from wobbling in a direction transverse to the axial direction. Thus, usability of the handle can be improved.

According to a further embodiment of the impact tool of the present invention, in the impact tool in which the handle is integrally formed with the outer shell housing, a rod-like member is provided in the tool body and slidably extends through the tool body in the axial direction of the tool bit. The rod-like member serves as a guide rail for guiding movement of the outer shell housing in the axial direction of the tool bit with respect to the tool body. With such a construction, movement of the outer shell housing in the axial direction of the tool bit with respect to the tool body can be stabilized, so that usability of the handle can be improved.

In a further embodiment of the impact tool of the present invention, the rod-like member and the outer shell housing are connected to each other via the first elastic element. Thus, a vibration-proofing structure for preventing vibration of the outer shell housing and the handle in a direction transverse to the axial direction of the tool bit can be rationally formed by the first elastic element.

In a further embodiment of the impact tool of the present invention, a dynamic vibration reducer for reducing vibration of the outer shell housing in the axial direction of the tool bit is provided in the outer shell housing. According to this invention, vibration in the axial direction of the tool bit which cannot be fully prevented by the second elastic element can be further reduced by the vibration reducing function of the dynamic vibration reducer.

Effect of the Invention

According to this invention, a technique for improving the vibration-proof effect and usability of a handle is provided in an impact tool.

REPRESENTATIVE EMBODIMENT OF THE INVENTION

First Embodiment of the Invention

Figure 1:
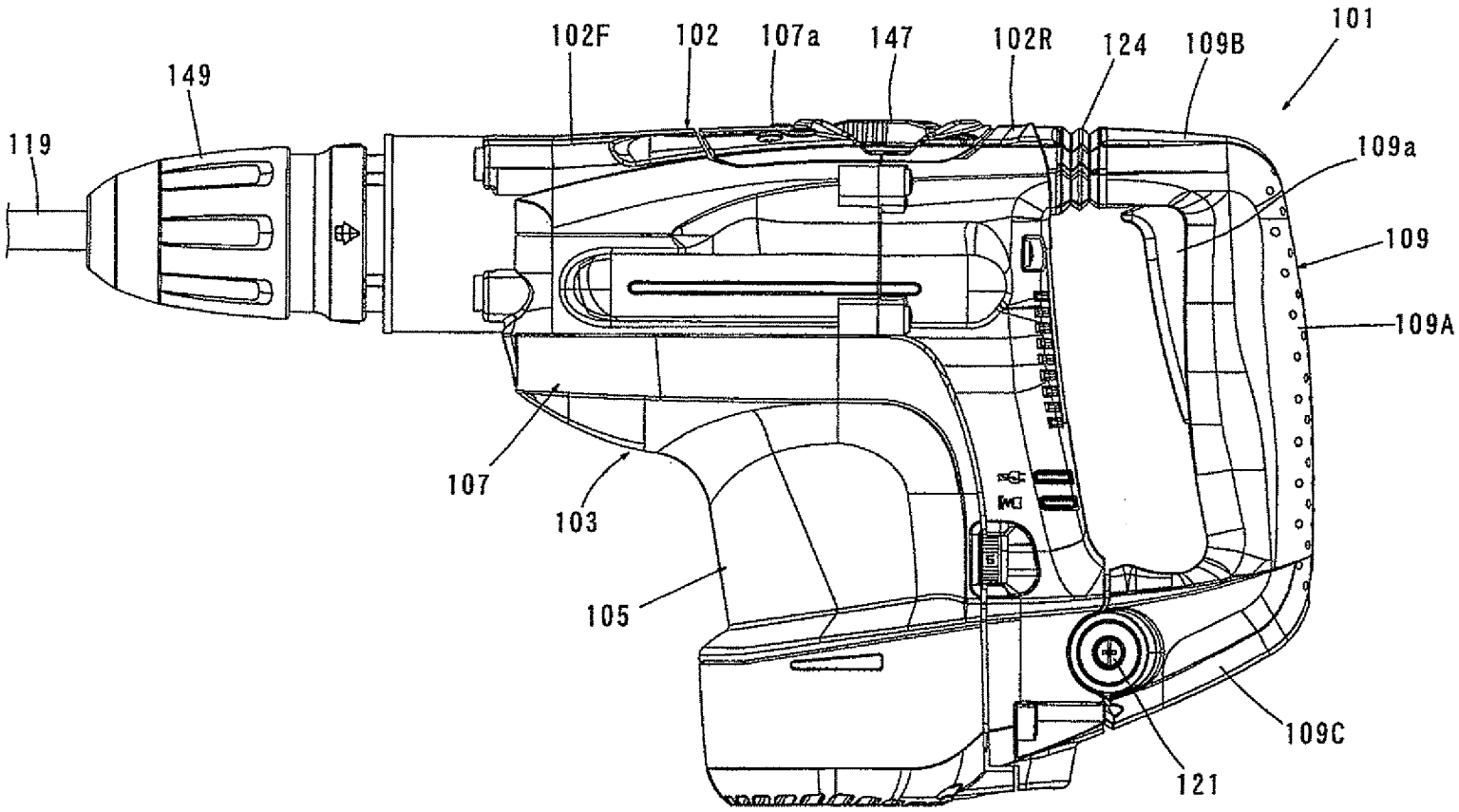
FIG. 1 is an external view showing an entire structure of a hammer drill according to a first embodiment of the present invention.
Figure 2:
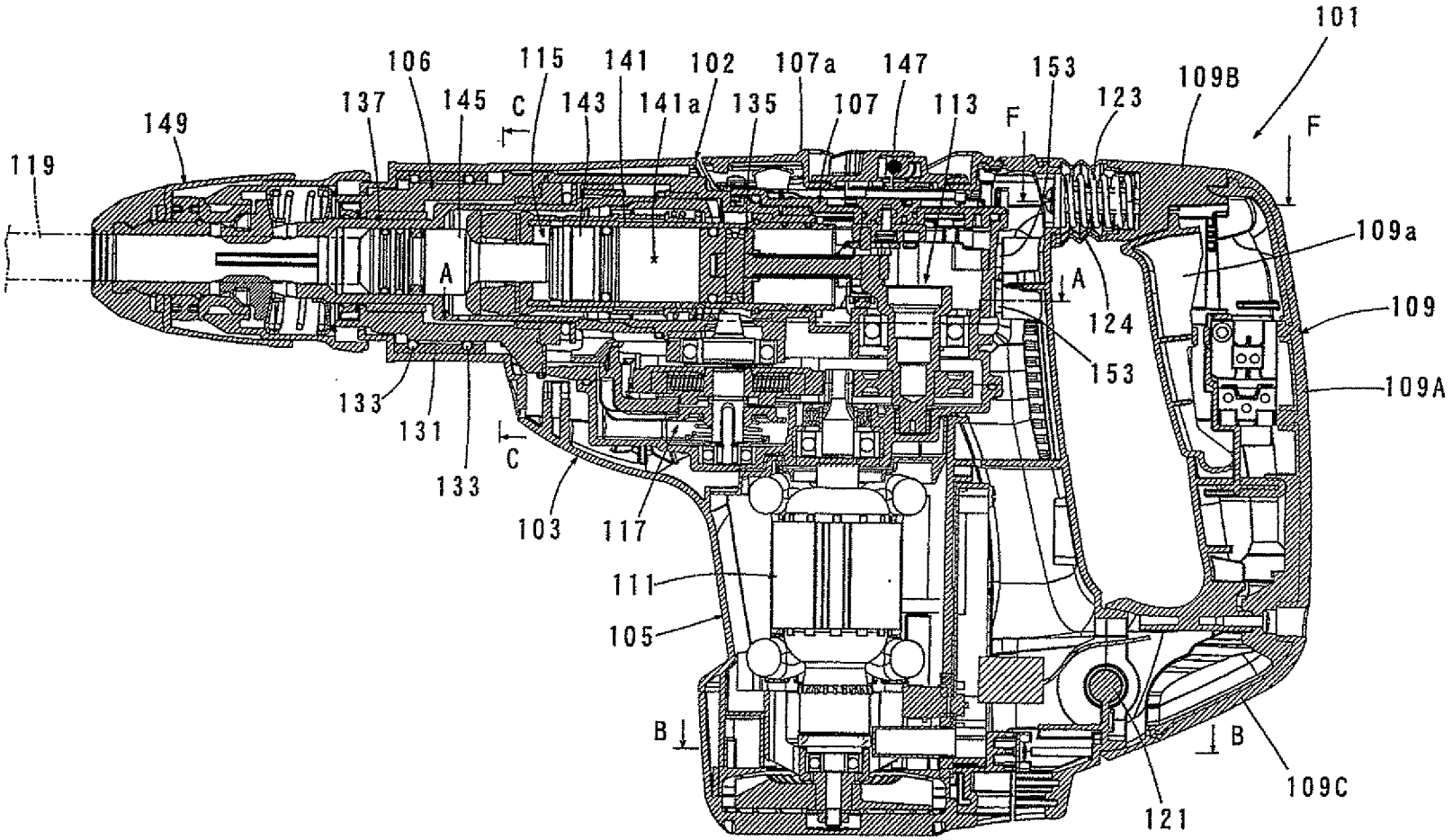
FIG. 2 is a sectional view showing an internal structure of the hammer drill.

A first embodiment of the present invention is now described with reference to FIGS. 1 to 10. This embodiment corresponds to the features as defined in claims 1 to 4. In this embodiment, an electric hammer drill is explained as a representative example of an impact tool. As shown in FIGS. 1 and 2, a hammer drill 101 according to this embodiment mainly includes an outer housing 102 that forms an outer shell of the hammer drill 101, a body 103 that is covered by the outer housing 102, a hammer bit 119 that is detachably coupled to a front end region (on the left as viewed in the drawings) of the body 103 via a hollow tool holder 137, and a handgrip 109 that is connected to the outer housing 102 on the side opposite from the hammer bit 119 and designed to be held by a user. The hammer bit 119 is held by the tool holder 137 such that it is allowed to linearly move with respect to the tool holder in its axial direction. The outer housing 102, the body 103, the hammer bit 119 and the handgrip 109 are features that correspond to the "outer shell housing", the "tool body", the "tool bit" and the "handle", respectively, according to the present invention. Further, for the sake of convenience of explanation, the side of the hammer bit 119 is taken as the front and the side of the handgrip 109 as the rear.

As shown in FIG. 2, the body 103 includes a motor housing 105 that houses a driving motor 111, and a crank housing 107 including a barrel 106 that houses a motion converting mechanism 113, a striking mechanism 115 and a power transmitting mechanism 117. The driving motor 111 is disposed such that its rotation axis runs in a vertical direction (vertically as viewed in FIG. 3) substantially perpendicular to a longitudinal direction of the body 103 (an axial direction of the hammer bit 119). The motion converting mechanism 113 appropriately converts torque of the driving motor 111 into linear motion and then transmits it to the striking mechanism 115. Then an impact force is generated in the axial direction of the hammer bit 119 (the horizontal direction as viewed in FIG. 1) via the striking mechanism 115. The motion converting mechanism 113 and the striking mechanism 115 are features that correspond to the "striking mechanism part" according to this invention. Further, the power transmitting mechanism 117 appropriately reduces the speed of torque of the driving motor 111 and transmits it to the hammer bit 119 via the tool holder 137, so that the hammer bit 119 is caused to rotate in its circumferential direction. The driving motor 111 is driven when a user depresses a trigger 109*a* disposed on the handgrip 109.

The motion converting mechanism 113 mainly includes a crank mechanism. The crank mechanism includes a driving element in the form of a piston 135 which forms a final movable member of the crank mechanism. When the crank mechanism is rotationally driven by the driving motor 111, the piston 135 is caused to linearly move in the axial direction of the hammer bit within a cylinder 141. The power transmitting mechanism 117 mainly includes a gear speed reducing mechanism having a plurality of gears and transmits torque of the driving motor 111 to the tool holder 137. Thus, the tool holder 137 is caused to rotate in a vertical plane and then the hammer bit 119 held by the tool holder 137 is also caused to rotate. Further, the constructions of the motion converting mechanism 113 and the power transmitting mechanism 117 are well known in the art and therefore their detailed description is omitted.

The striking mechanism 115 mainly includes a striking element in the form of a striker 143 that is slidably disposed within the bore of the cylinder 141 together with the piston 135, and an intermediate element in the form of an impact bolt 145 that is slidably disposed within the tool holder 137. The striker 143 is driven via air spring action (pressure fluctuations) of an air chamber 141*a* of the cylinder 141 by sliding movement of the piston 135. The striker 143 then collides with (strikes) the impact bolt 145. As a result, a striking force caused by the collision is transmitted to the hammer bit 119 via the impact bolt 145.

An operation mode switching dial 147 is mounted on a top cover 107*a* of the crank housing 107 and can be appropriately operated by a user in order to switch the hammer drill 101 between hammer mode and hammer drill mode. In hammer mode, an operation is performed on a workpiece by applying only a striking force to the hammer bit 119 in the axial direction, and in hammer drill mode, an operation is performed on a workpiece by applying a striking force in the axial direction and a rotating force in the circumferential direction to the hammer bit 119. The operation mode switching between hammer mode and hammer drill mode is a known technique and not directly related to the present invention, and therefore their detailed description is omitted.

In the hammer drill 101 constructed as described above, when the driving motor 111 is driven, the rotating output of the motor is converted into linear motion via the motion converting mechanism 113 and then causes the hammer bit 119 to perform linear movement or striking movement in the axial direction via the striking mechanism 115. Further, in addition to the above-described striking movement, rotation is transmitted to the hammer bit 119 via the power transmitting mechanism 117 which is driven by the rotating output of the driving motor 111. Thus, the hammer bit 119 is caused to rotate in the circumferential direction. Specifically, during operation in hammer drill mode, the hammer bit 119 performs striking movement in the axial direction and rotation in the circumferential direction, so that a hammer drill operation is performed on the workpiece. During operation in hammer mode, torque transmission of the power transmitting mechanism 117 is interrupted by a clutch. Therefore, the hammer bit 119 is caused to perform only striking movement in the axial direction, so that a hammering operation is performed on the workpiece.

During the above-described hammering or hammer drill operation, in the body 103, not only impulsive and cyclic vibration is caused in the axial direction of the hammer bit 119, but also vibration is caused in a direction transverse to the axial direction. Now, a vibration-proofing structure is explained which serves to prevent or reduce transmission of vibration from the body 103 to the handgrip 109 designed to be held by a user.

Figure 3:
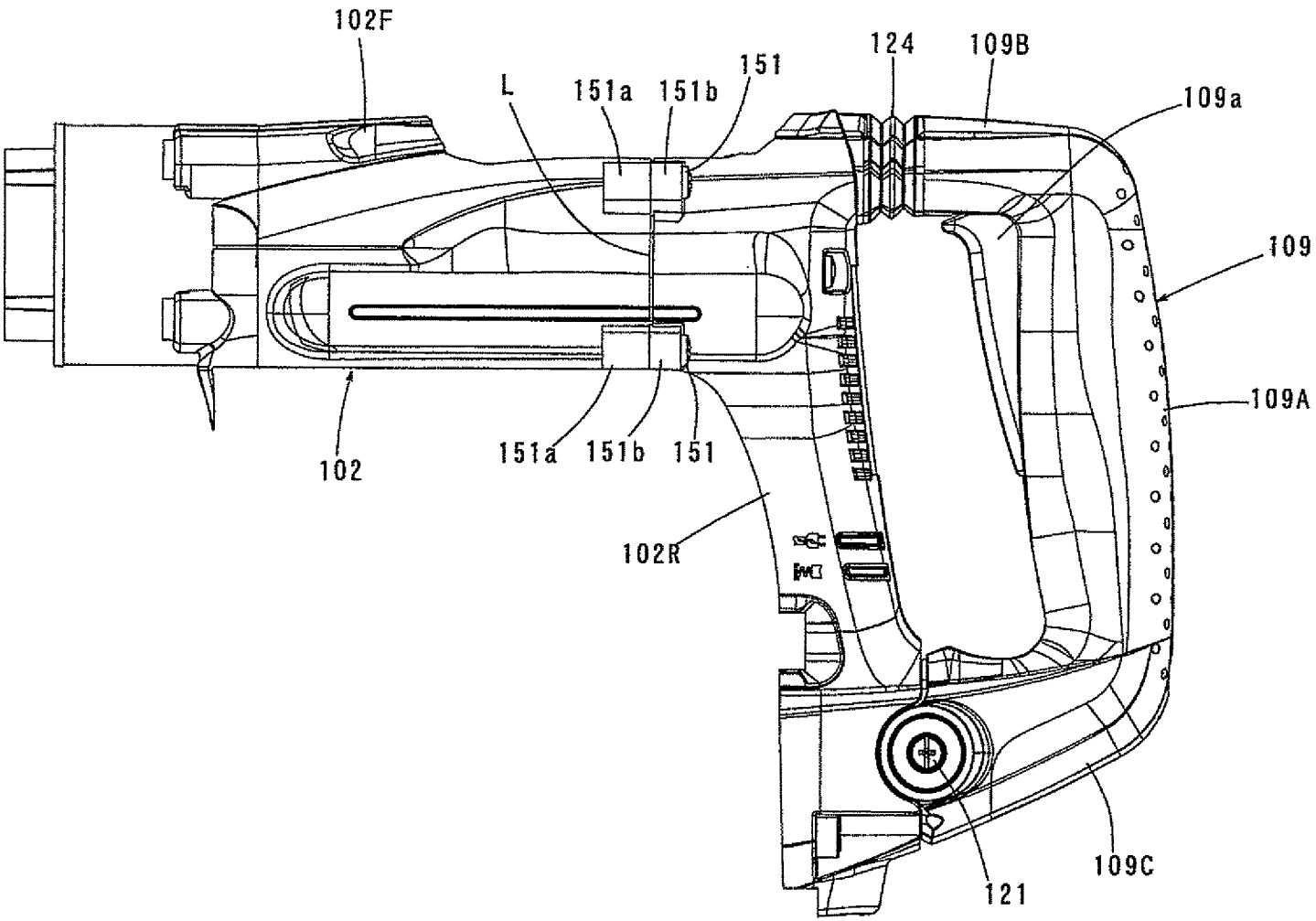
FIG. 3 is an external view showing an outer housing and a handgrip connected to the outer housing of the hammer drill.

FIG. 3 shows the outer housing 102 that covers the body 103, and the handgrip 109 mounted to the outer housing 102. As clearly seen from a comparison between FIG. 3 and FIG. 1, the outer housing 102 covers a region of the body 103 other than the motor housing 105. Further, naturally, parts to be operated by a user, and more specifically, a chuck 149 which is disposed in a front end region of the tool holder 137 in order to detachably mount the hammer bit 119 to the tool holder 137, and the operation mode switching dial 147, are exposed from the outer housing 102.

The outer housing 102 is generally L-shaped as viewed from the side and has a generally cylindrical front part 102F extending substantially horizontally in the axial direction of the hammer bit 119 and an oblong rear part 102R extending downward from a rear end of the front part 102F. The outer housing 102 is split into two parts, or the front part 102F and the rear part 102R, in the axial direction of the hammer bit 119. A parting line (mating face) is shown and designated by L in FIG. 3. In the following description, the front part 102F is referred to as a front housing part and the rear part 102R as a rear housing part. In order to assemble the front and rear housing parts 102F, 102R together, mating faces L (a rear surface of the front housing part 102F and a front surface of the rear housing part 102R) are butted with each other, and in this state, a plurality of front and rear connecting bosses 151*a*, 151*b* formed on the outer peripheries of the front and rear housing parts are clamped and connected together by screws 151. The front and rear housing parts 102F, 102R are features that correspond to the "plurality of split elements" according to this invention.

The outer housing 102 constructed as described above is connected to the body 103 via vibration-proofing first to fourth elastic rubbers 153, 155, 157, 159 and can move with respect to the body 103 in the axial direction of the hammer bit 119 and in a vertical direction and a lateral direction which are transverse to the axial direction. In other words, the outer housing 102 is supported via the first to fourth elastic rubbers 153, 155, 157, 159 in no contact with an outer surface of the body 103 (in a floating state). The elastic rubbers 153, 155, 157, 159 are now explained below.

Figure 4:
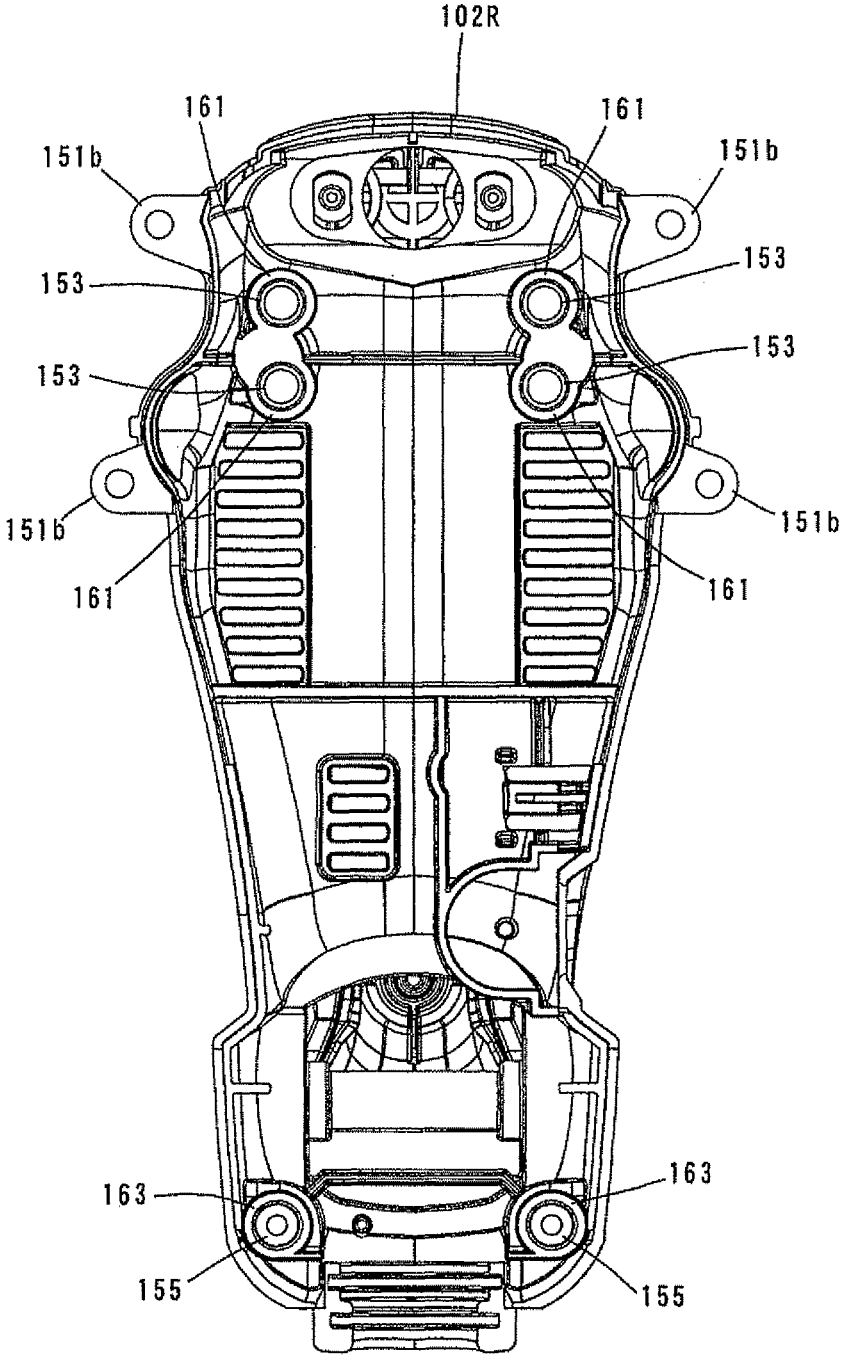
FIG. 4 shows a rear housing part of the outer housing which is split in a longitudinal direction, as viewed from the front (the hammer bit side).
Figure 5:
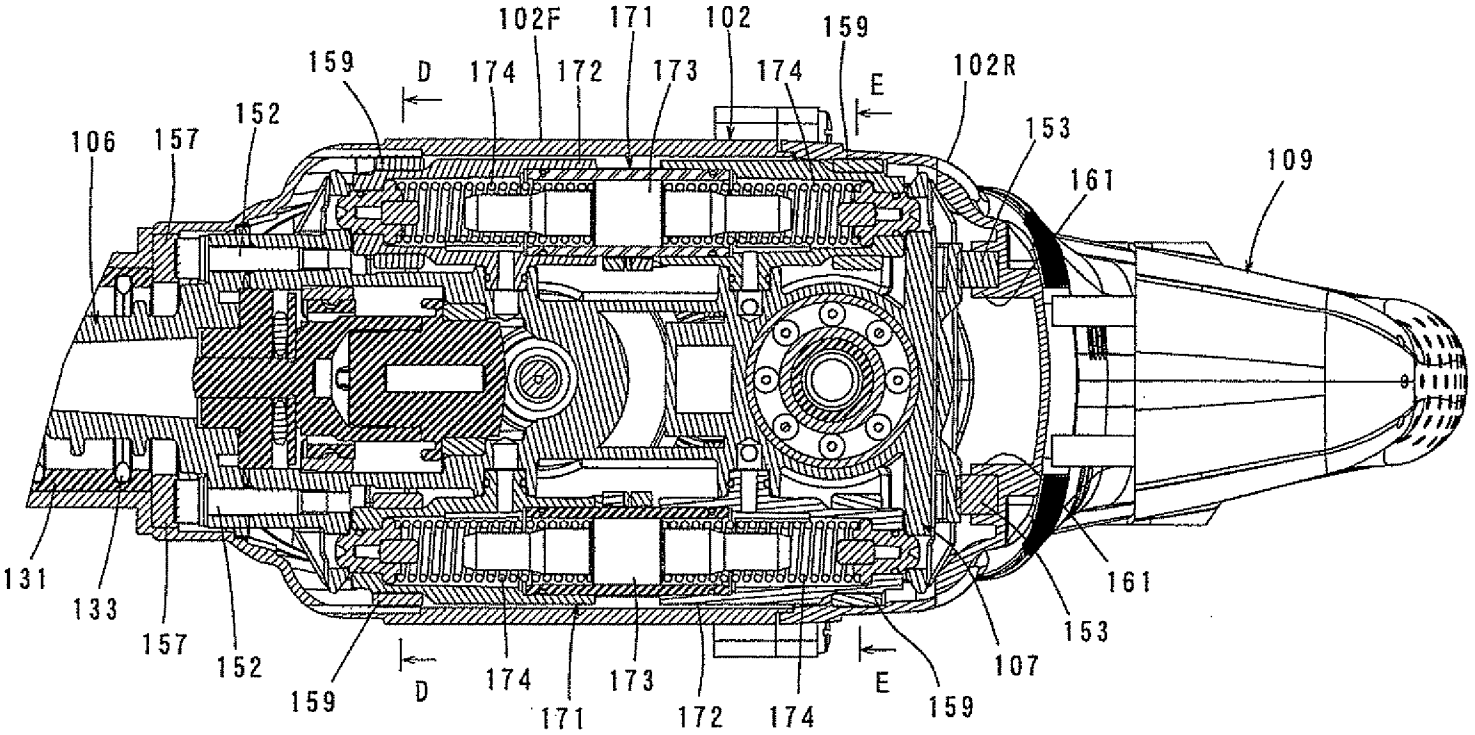
FIG. 5 is a sectional view taken along line A-A in FIG. 2.

As for the first elastic rubber 153, as shown in FIGS. 4 and 5, a total of four upper and lower, right and left elastic rubbers are disposed between an upper portion of the front surface of the rear housing part 102R and an upper portion of the rear end surface of the crank housing 107, on the upper and lower, right and left sides with respect to the axis of the hammer bit 119. Each of the first elastic rubbers 153 has a cylindrical form, and is housed and held in a generally cylindrical part 161 formed on the rear housing part 102R. Further, a front surface of the first elastic rubber 153 is held in surface contact with an upper portion of the rear end surface of the crank housing 107. Thus, by frictional force between the contact surfaces, the first elastic rubber 153 is prevented from moving with respect to the crank housing 107.

Figure 6:
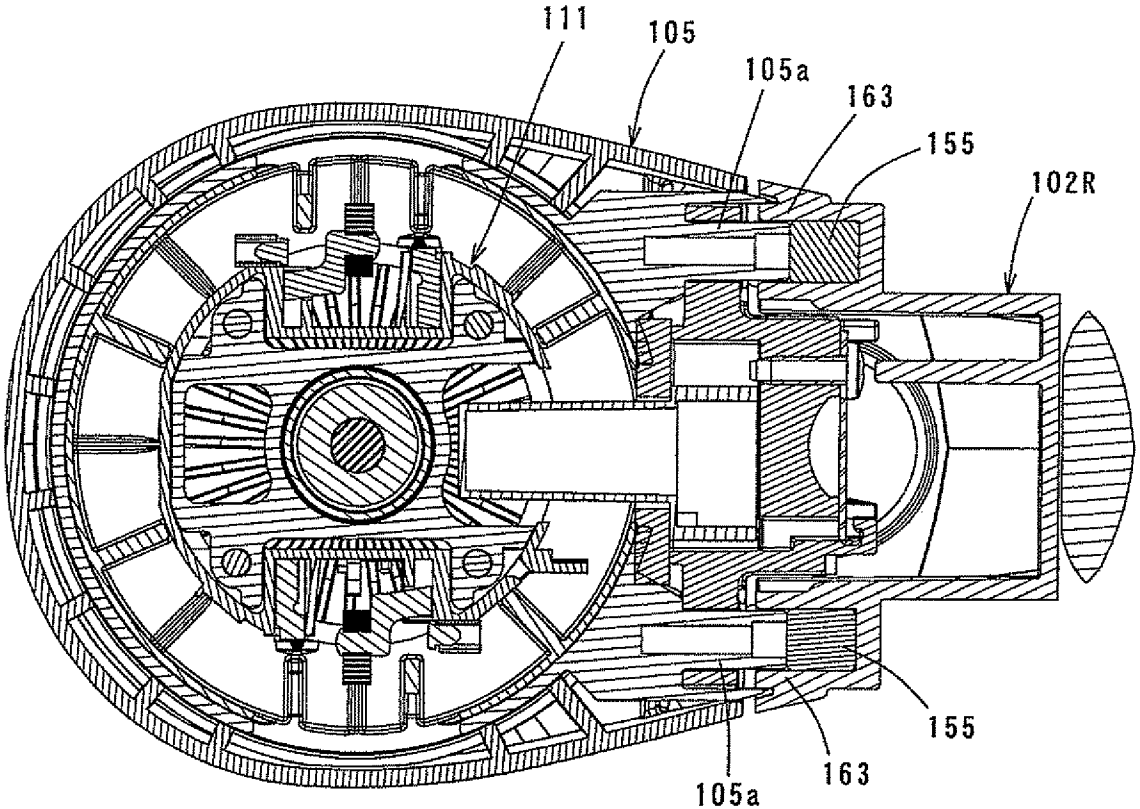
FIG. 6 is a sectional view taken along line B-B in FIG. 2.

As shown in FIGS. 4 and 6, a total of two right and left second elastic rubbers 155 are disposed between a lower portion of the front surface of the rear housing part 102R and a lower portion of the rear surface of the motor housing 105, on the right and left sides of a vertical line perpendicular to the axis of the hammer bit 119. Each of the second elastic rubbers 155 has a cylindrical form, and is housed and held in a generally cylindrical part 163 formed in the rear housing part 102R. A front surface of the second elastic rubber 155 is held in surface contact with a rear end surface of a pin-like protrusion 105*a* of the motor housing 105 which is loosely fitted into the cylindrical part 163. Thus, by frictional force between the contact surfaces, the second elastic rubber 155 is prevented from moving with respect to the motor housing 105.

Figure 7:
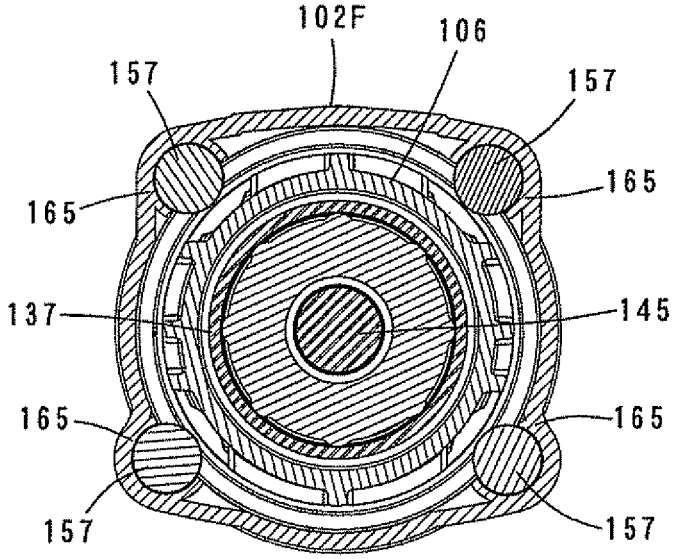
FIG. 7 is a sectional view taken along line C-C in FIG. 2.

As shown in FIGS. 5 and 7, a total of four upper and lower, right and left third elastic rubbers 157 are disposed between a rear surface of a radial wall surface of the front housing part 102F and a head of a screw 152 which connects a front part and a rear part of the barrel 106, on the upper and lower, right and left sides with respect to the axis of the hammer bit 119. Each of the third elastic rubbers 157 has a cylindrical form, and is housed and held in a generally cylindrical part 165 formed on the front housing part 102F. Further, a rear surface of the third elastic rubber 157 is held in surface contact with the head of the screw 152. Thus, by frictional force between the contact surfaces, the third elastic rubber 157 is prevented from moving with respect to the barrel 106.

In order to assemble the split front and rear housing parts 102F, 102R into the outer housing 102, the front housing part 102F is fitted onto the barrel 106 from the front, and the rear housing part 102R is fitted onto the crank housing 107 and the motor housing 105 from the rear, so that the housing parts 102F, 102R are opposed to each other, and in this state, the screws 151 are threadably inserted into the connecting bosses 151*a*, 151*b* of the housing parts 102F, 102R and tightened. At this time, the above-described first to third elastic rubbers 153, 155, 157 are pressed against the crank housing 107, the motor housing 105 and the barrel 106 in the axial direction of the hammer bit 119 (the mating direction of the outer housing 102). Specifically, when the outer housing 102 is mounted to the body 103, the first to third elastic rubbers 153, 155, 157 are elastically held between the outer housing 102 and the body 103. In this case, the first to third elastic rubbers 153, 155, 157 are held by the associated cylindrical parts 161, 163, 165 formed on the outer housing 102, which facilitates mounting of the first to third elastic rubbers 153, 155, 157.

The above-described first to third elastic rubbers 153, 155, 157 serve to reduce transmission of vibration from the body 103 to the outer housing 102 in the vertical direction and the lateral direction transverse to the axial direction of the hammer bit 119. The first to third elastic rubbers 153, 155, 157 are features that correspond to the "first elastic element" according to this invention.

The hammer drill 101 according to this embodiment has a dynamic vibration reducer 171 for reducing vibration which is caused in the body 103 in the axial direction of the hammer bit 119, and the fourth elastic rubber 159 is mounted to the dynamic vibration reducer 171. As shown in FIG. 5, the dynamic vibration reducer 171 mainly includes an elongate hollow dynamic vibration reducer body in the form of a cylindrical element 172, a weight 173 disposed within the cylindrical element 172 and elastic elements in the form of biasing springs 174 which are disposed on the front and rear sides of the weight 173 in its longitudinal direction in order to connect the weight 173 and the cylindrical element 172. The dynamic vibration reducers 171 thus constructed are disposed on the right and left side surfaces of the crank housing 107 in the body 103 on the opposite sides of the axis of the hammer bit 119, and mounted parallel to each other such that the weight 173 moves in the axial direction of the hammer bit 119. The dynamic vibration reducer 171 forms a vibration reducing mechanism in which the weight 173 connected to the cylindrical element 172 via the biasing springs 174 moves opposite to the direction of vibration which is caused in the body 103 in the axial direction of the hammer bit 119, so that vibration of the body 103 is reduced.

Figure 8:
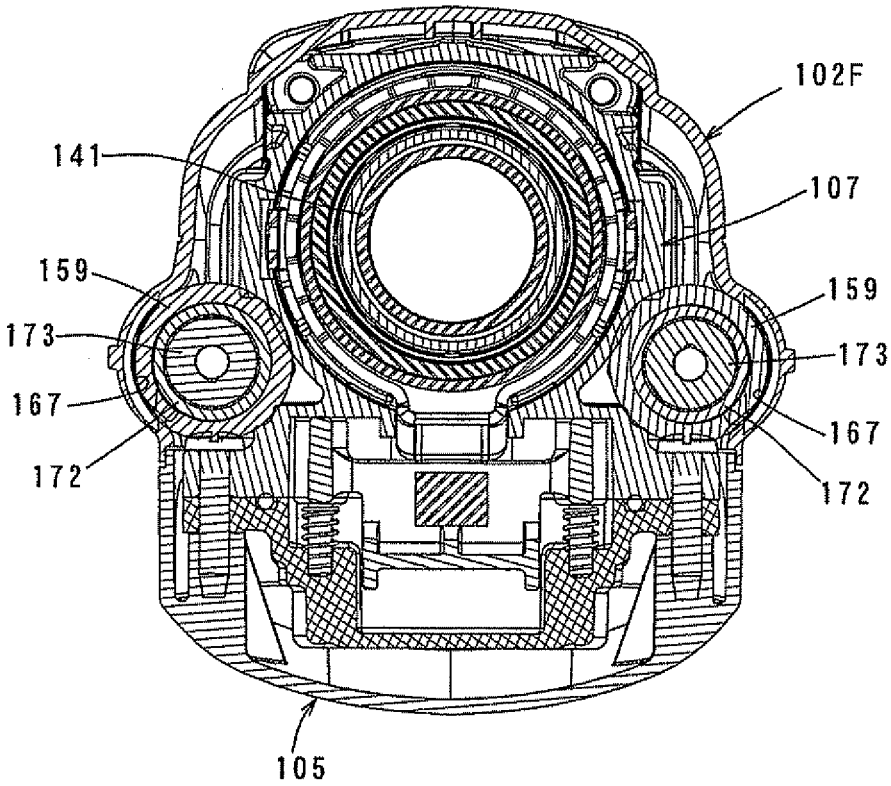
FIG. 8 is a sectional view taken along line D-D in FIG. 5.
Figure 9:
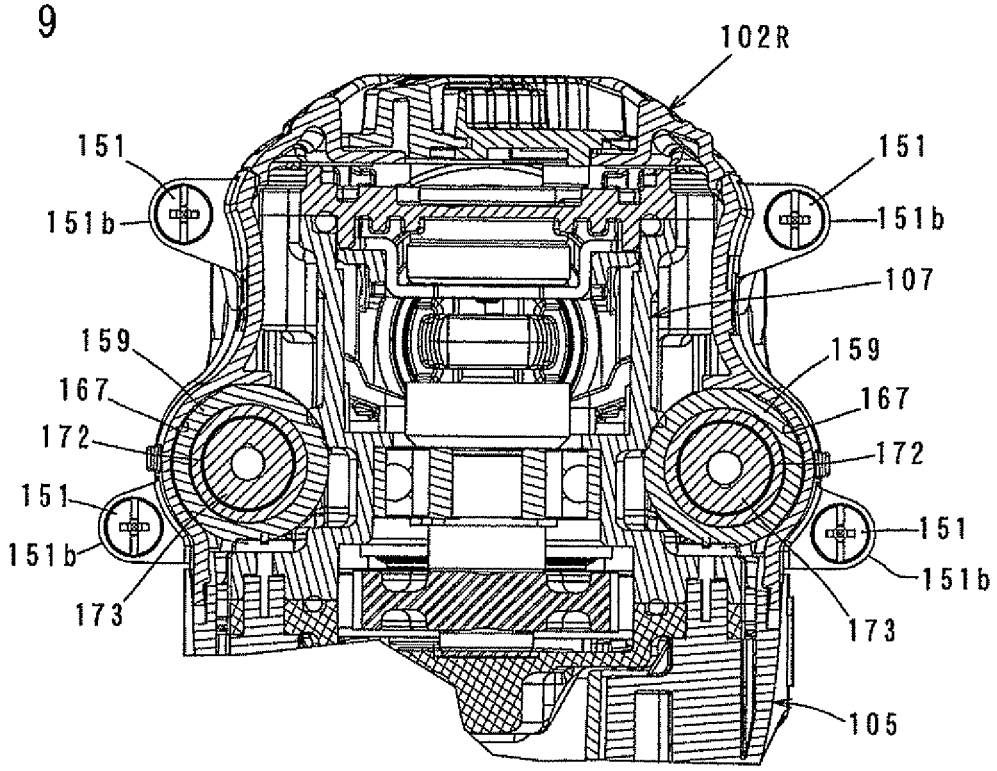
FIG. 9 is a sectional view taken along line E-E in FIG. 5.

The fourth elastic rubber 159 has a ring-like form, and as shown in FIGS. 5, 8 and 9, a total of four elastic rubbers 159 are provided and fitted onto the front and rear of the cylindrical element 172 of each of the right and left dynamic vibration reducers 171. An arcuate engagement part 167 is formed in a region of an inner surface of each of the front and rear housing parts 102F, 102R of the outer housing 102 which faces a side region of the fourth elastic rubber 159, and the side surface of the fourth elastic rubber 159 is elastically engaged with the engagement part 167 in surface contact. With such a construction, the fourth elastic rubber 159 serves to reduce transmission of vibration from the body 103 to the outer housing 102 in the vertical direction and the lateral direction which are transverse to the axis of the hammer bit 119. The fourth elastic rubber 159 is a feature that corresponds to the "first elastic element" according to this invention.

As shown in FIG. 2, a sleeve 131 is disposed between an inner surface of the front housing part 102F of the outer housing 102 and an outer surface of the barrel 106. The sleeve 131 is held in surface contact with an inner circumferential surface of the front housing part 102F and elastically held in contact with an outer circumferential surface of the barrel 106 via two front and rear O-rings 133. The O-ring 133 is made of rubber and serves to position the outer housing 102 in its radial direction (in a direction transverse to the axial direction of the hammer bit 119) with respect to the barrel 106. Further, the O-ring 133 elastically deforms in the radial direction so that the outer housing 102 is allowed to move with respect to the barrel 106. Thus, the O-ring 133 also serves as a vibration-proofing member. The O-ring 133 is a feature that corresponds to the "first elastic element" according to this invention.

As shown in FIGS. 1 to 3, the handgrip 109 is generally D-shaped as viewed from the side and has a grip region 109A extending in the vertical direction transverse to the axial direction of the hammer bit 119, and connecting regions 109B, 109C extending horizontally forward from upper and lower ends of the grip region 109A. Further, front ends of the upper and lower connecting regions 109B, 109C are connected to a rear end of the rear housing part 102R of the outer housing 102. The lower connecting region 109C of the handgrip 109 is connected to a lower end portion of the rear housing part 102R such that it can rotate on a pivot 121 in the axial direction of the hammer bit 119. The upper connecting region 109B is connected to an upper end portion of the rear housing part 102R via a vibration-proofing compression coil spring 123 such that it can move in the axial direction of the hammer bit 119 with respect to the rear housing part 102R.

Figure 10:
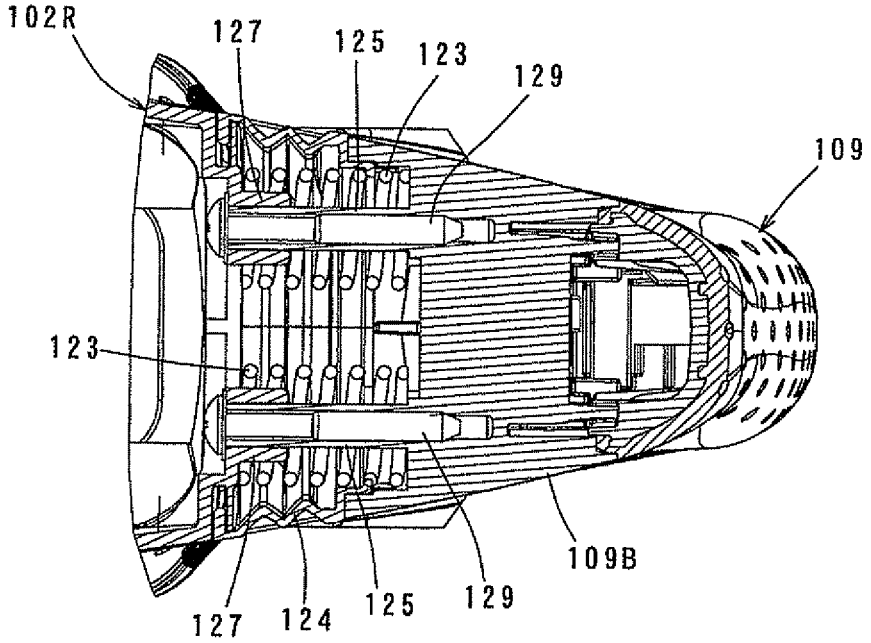
FIG. 10 is a sectional view taken along line F-F in FIG. 2.

As shown in FIG. 10, two right and left compression coil springs 123 are disposed on the opposite sides of the axis of the hammer bit 119 such that they can be expanded and compressed in the axial direction of the hammer bit 119. Each of the compression coil springs 123 is elastically disposed between the handgrip 109 and the rear housing part 102R, and its one end is held in contact with a spring seating surface on the handgrip 109 side and the other end is held in contact with a spring seating surface on the rear housing part 102R side. The compression coil springs 123 thus arranged serve to reduce transmission of vibration from the body 103 to the handgrip 109 via the outer housing 102 in the axial direction of the hammer bit 119. The compression coil spring 123 is a feature that corresponds to the "second elastic element" and the "mechanical spring" according to this invention. Further, the compression coil spring 123 is covered by a dustproof cover 124 disposed between the handgrip 109 and the rear housing part 102R.

A sliding member in the form of a columnar element 125 is formed on an upper end portion of the handgrip 109 and extends horizontally forward through the compression coil spring 123. The columnar element 125 slides within a cylindrical member 127 which is formed as a sliding guide on the rear surface of the rear housing part 102R, so that movement of the handgrip 109 in the axial direction of the hammer bit with respect to the rear housing part 102R can be stabilized. Further, a stopper bolt 129 is inserted into the columnar element 125 and a head of the stopper bolt 129 comes in contact with a front surface of the cylindrical member 127, so that an end of rearward movement of the handgrip 109 is defined.

In this embodiment, as described above, the outer housing 102 covering the body 103 is connected to the body 103 via the first to third elastic rubbers 153, 155, 157 such that it can move in the axial direction of the hammer bit 119 with respect to the body 103, and also connected to the body 103 via the fourth elastic rubber 159 and the O-ring 133 such that it can move in a direction transverse to the axial direction of the hammer bit 119 with respect to the body 103. With such a construction, as for vibration which is caused in the body 103 by striking the hammer bit 119 and transmitted from the body 103 to the outer housing 102 during hammering or hammer drill operation, vibration in the vertical and lateral directions transverse to the axial direction of the hammer bit 119 is reduced by the fourth elastic rubber 159 and vibration in the axial direction is reduced by the first to third elastic rubbers 153, 155, 157. In this manner, the outer housing 102 is made proof against vibration in all directions, or in the axial direction of the hammer bit and in the vertical and lateral directions transverse to the axial direction.

The handgrip 109 is connected to the outer housing 102 via the compression coil spring 123 such that it can move in the axial direction of the hammer bit 119 with respect to the outer housing 102. Therefore, vibration in the axial direction of the hammer bit 119 which is transmitted from the outer housing 102 to the handgrip 109 is reduced by the compression coil spring 123.

As described above, according to this embodiment, as for vibration caused in the body 103, vibration in the axial direction of the hammer bit 119 is mainly reduced by the compression coil spring 123 which connects the outer housing 102 and the handgrip 109, and vibration in a direction transverse to the axial direction is reduced by the fourth elastic rubber 159 which connects the body 103 and the outer housing 102. Thus, the handgrip 109 is made proof against vibration in the axial direction of the hammer bit 119 and in a direction transverse to the axial direction, and further, the fourth elastic rubber 159 for preventing vibration in a direction transverse to the axial direction is designed to have a relatively high spring stiffness by increasing its spring constant. With this construction, the handgrip 109 can be prevented from wobbling in a direction transverse to the axial direction with respect to the body 103, so that usability can be enhanced.

In this embodiment, as described above, the first to third elastic rubbers 153, 155, 157 are disposed between the outer housing 102 and the body 103, and when the front housing part 102F and the rear housing part 102R are clamped and connected together by the screws 151, the elastic rubbers are held compressed therebetween. Further, vibration of the handgrip 109 in the axial direction of the hammer bit is mainly prevented by the compression coil spring 123. With this construction, the first to third elastic rubbers 153, 155, 157 may be designed such that the elastic rubbers compressed as described above can further compressively deform (can prevent vibration in the axial direction), or such that they cannot further compressively deform (cannot prevent vibration in the axial direction).

Further, in this embodiment, the body 103 has the dynamic vibration reducer 171. Therefore, the weight 173 and the biasing spring 174 which serve as vibration reducing elements of the dynamic vibration reducer 171 cooperate to actively reduce vibration caused in the body 103 in the axial direction of the hammer bit 119. Thus, vibration of the body 103 can be prevented.

Second Embodiment of the Invention

A second embodiment of the present invention is now described with reference to FIGS. 11 to 14. The second embodiment corresponds to the features as defined in claims 1 to 4. This embodiment relates to a modification to the vibration-proofing structure of the outer housing 102, and more particularly to a modification to the vibration-proofing structure for preventing vibration in a direction transverse to the axial direction of the hammer bit 119. Structures of this embodiment other than the vibration-proofing structure, such as an entire structure of the hammer drill 101, a structure for driving the hammer bit 119, and a structure for mounting the handgrip 109, are identical to those in the above-described first embodiment. Therefore, components which are substantially identical to those in the first embodiment are given like numerals as in the first embodiment and are not described or briefly described.

Figure 11:
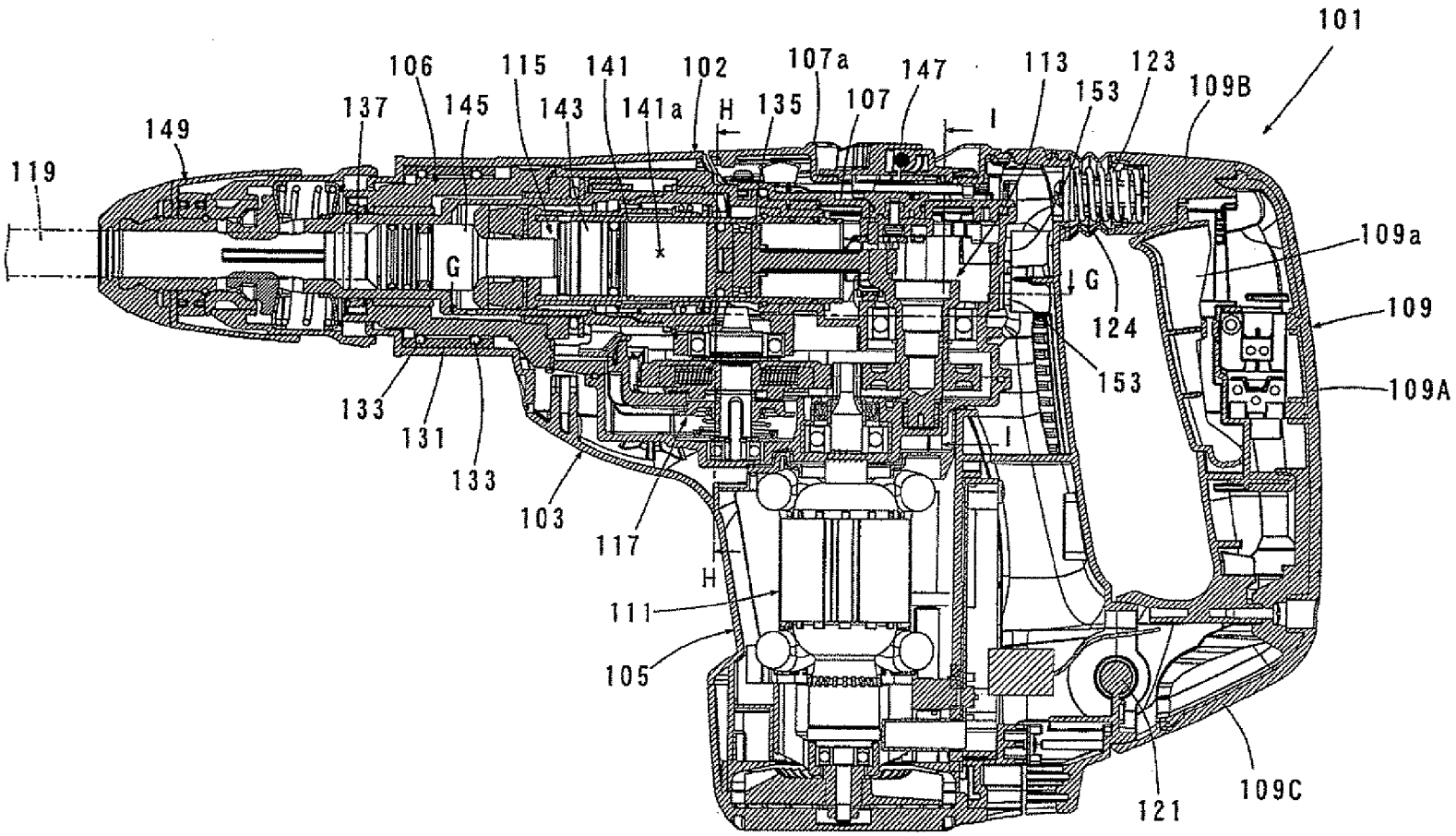
FIG. 11 is a sectional view showing an entire structure of a hammer drill according to a second embodiment of the present invention.
Figure 12:
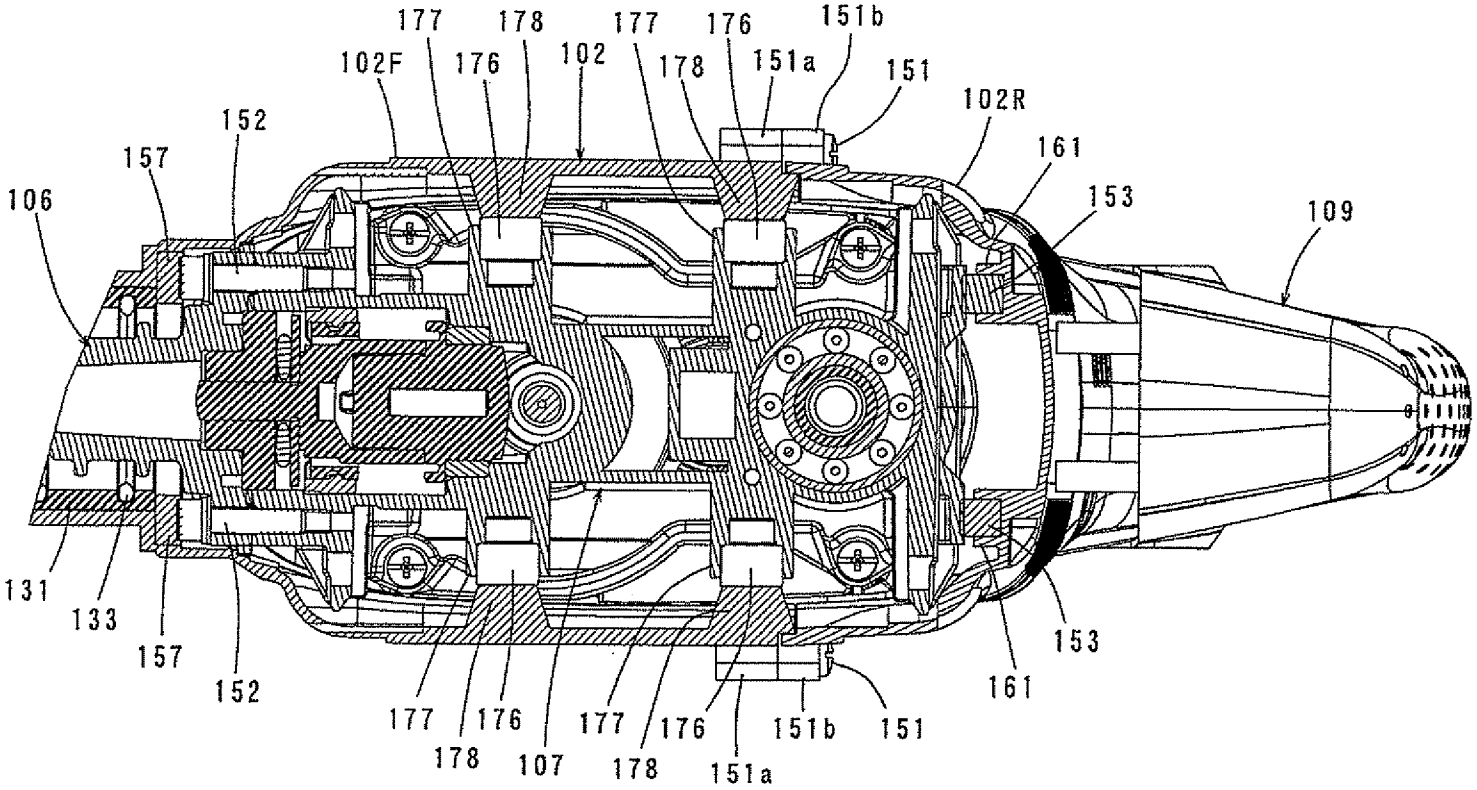
FIG. 12 is a sectional view taken along line G-G in FIG. 11.

As shown in FIG. 12, the outer housing 102 is elastically connected to the body 103 via the vibration-proofing first to third elastic rubbers 153, 155, 157 (see FIG. 6 as to the second elastic rubber 155). Further, as shown in FIG. 11, a front end of the outer housing 102 is connected to the barrel 106 via the sleeve 131 and the O-ring 133. As shown in FIG. 11, the lower connecting region 109C of the handgrip 109 is connected to the lower end portion of the rear housing part 102R such that it can rotate on the pivot 121 in the axial direction of the hammer bit 119 and the upper connecting region 109B is connected to the upper end portion of the rear housing part 102R via the compression coil spring 123 such that it can move in the axial direction of the hammer bit 119 with respect to the rear housing part 102R. The above-described construction is the same as in the first embodiment.

Figure 13:
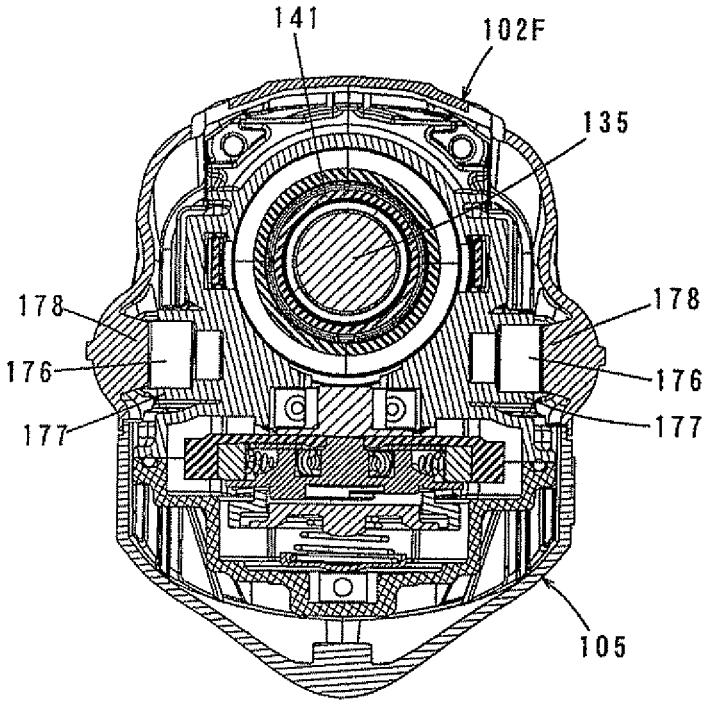
FIG. 13 is a sectional view taken along line H-H in FIG. 11.
Figure 14:
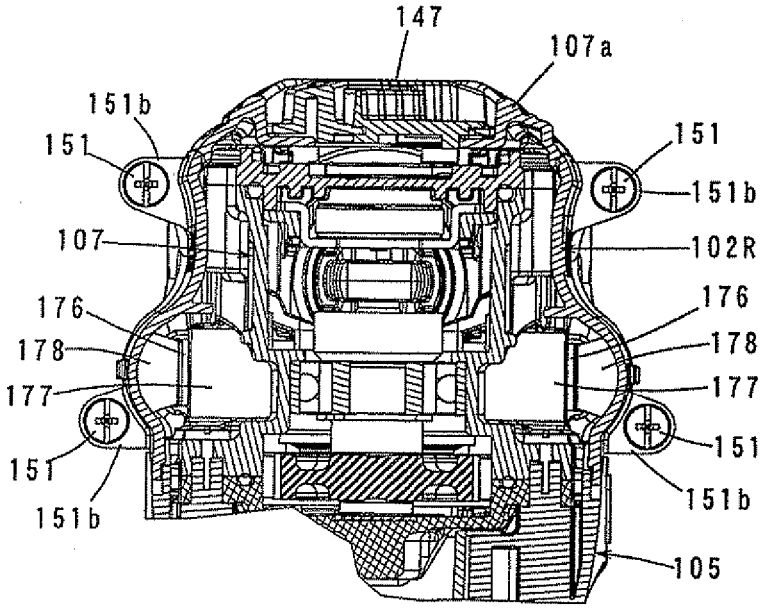
FIG. 14 is a sectional view taken along line I-I in FIG. 11.

In this embodiment, the body 103 of the hammer drill 101 is not provided with the dynamic vibration reducer 171 described in the first embodiment. As shown in FIGS. 12 to 14, fifth elastic rubbers 176 are disposed in right and left side regions of the crank housing 107 in the body 103, and the outer housing 102 is connected to the body 103 via the fifth elastic rubber 176 such that it can move in a direction transverse to the axial direction of the hammer bit 119 with respect to the body 103. The fifth elastic rubber 176 corresponds to the fourth elastic rubber 159 described in the first embodiment and is a feature that corresponds to the "first elastic element" according to this invention.

A total of four front and rear, right and left fifth elastic rubbers 176 are disposed between right and left outer side surfaces of the crank housing 107 and right and left inner side surfaces of the front housing part 102F of the outer housing 102 which face each other. Each of the fifth elastic rubbers 176 is cylindrically-shaped, and housed and held within a generally circular cylindrical part 177 which is formed on the crank housing 107 and has a lateral opening. In this state, part of the fifth elastic rubber 176 protrudes from the cylindrical part 177. The protruding end surface of the fifth elastic rubber 176 is held in surface contact with a protrusion 178 formed on the inner side of the front housing part 102F. Thus, by frictional force between the contact surfaces, the fifth elastic rubber 176 is prevented from moving with respect to the front housing part 102F.

According to this embodiment constructed as described above, the fifth elastic rubber 176 can prevent vibration of the outer housing 102 by reducing vibration caused in the body 103 in the lateral direction transverse to the axial direction of the hammer bit 119. Further, the other effects of this embodiment are the same as the effects of the first embodiment.

In this embodiment, with the construction in which the fifth elastic rubber 176 is held by the cylindrical part 177 of the crank housing 107, the fifth elastic rubber 176 can be prevented from slipping off when assembling the front housing part 102F and the rear housing part 102R, so that the assembling operation can be easily performed. The location of the cylindrical part 177 may be changed from the crank housing 107 side to the outer housing 102 side.

Third Embodiment of the Invention

Figure 15:
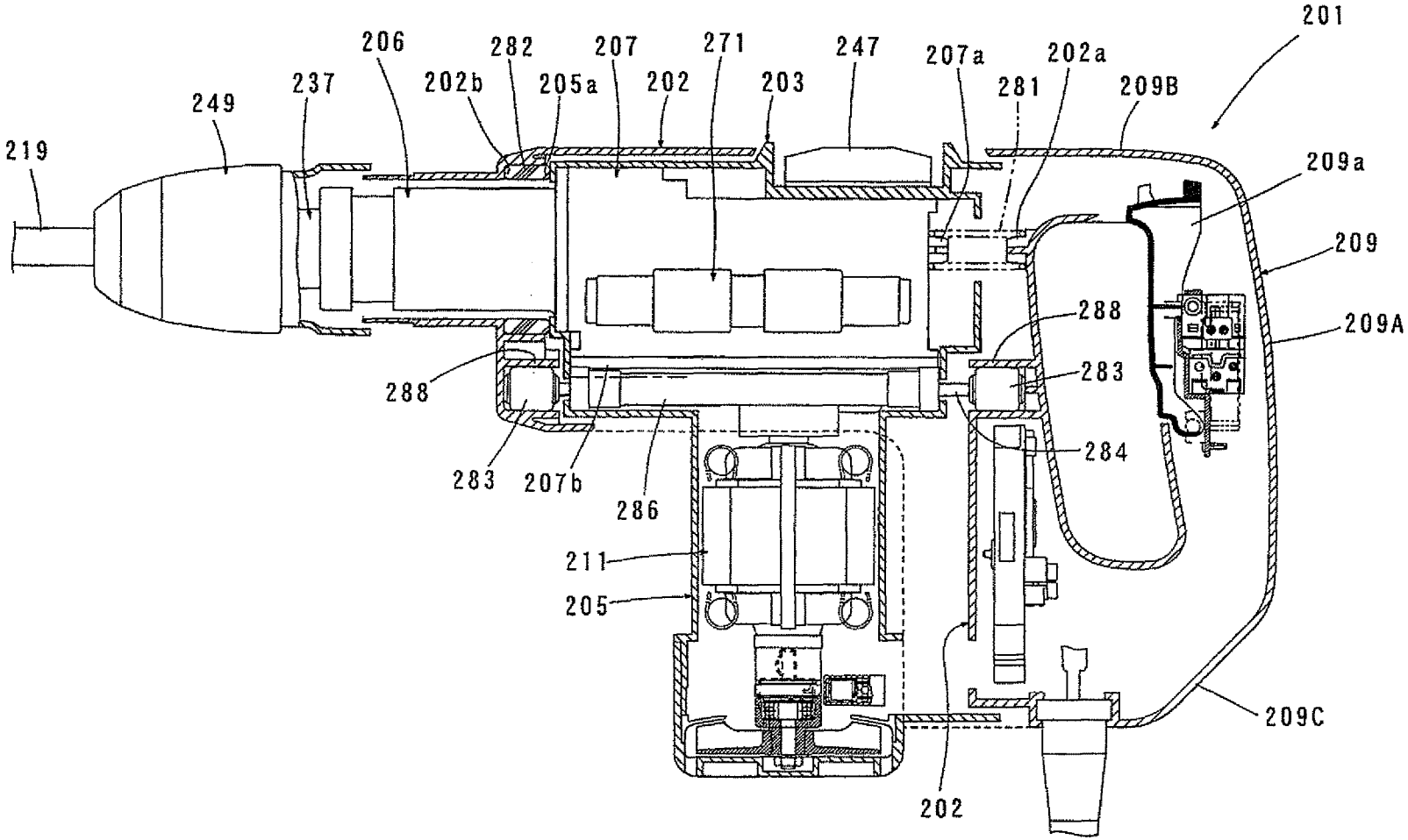
FIG. 15 is a sectional view showing an entire structure of a hammer drill according to a third embodiment of the present invention.

A third embodiment of the present invention is now described with reference to FIGS. 15 to 18. The third embodiment corresponds to the features as defined in claims 5 to 7. As shown in FIG. 15, a hammer drill 201 according to this embodiment mainly includes an outer housing 202 that forms an outer shell of the hammer drill 201, a body 203 that is covered by the outer housing 202, a hammer bit 219 detachably coupled to a front end region (on the left as viewed in the drawings) of the body 203 via a hollow tool holder 237, and a handgrip 209 designed to be held by a user and connected to the outer housing 202 on the side opposite to the hammer bit 219. The hammer bit 219 is held by the tool holder 237 such that it is allowed to linearly move with respect to the tool holder in its axial direction. The outer housing 202, the body 203, the hammer bit 219 and the handgrip 209 are features that correspond to the "outer shell housing", the "tool body", the "tool bit" and the "handle", respectively, according to the present invention. Further, for the sake of convenience of explanation, the side of the hammer bit 219 is taken as the front and the side of the handgrip 209 as the rear.

The body 203 includes a motor housing 205 that houses a driving motor 211, and a crank housing 207 including a barrel 206 that houses a motion converting mechanism, a striking mechanism and a power transmitting mechanism which are not shown. The crank housing 207 is designed such that its regions other than the barrel 206 are housed in the motor housing 205, and is connected to the motor housing 205. The driving motor 211 is disposed such that its rotation axis runs in a vertical direction (vertically as viewed in FIG. 15) substantially perpendicular to a longitudinal direction of the body 203 (the axial direction of the hammer bit 219).

The motion converting mechanism appropriately converts torque of the driving motor 211 into linear motion and then transmits it to the striking mechanism, so that the hammer bit 219 is caused to perform striking movement in its axial direction via the striking mechanism. The motion converting mechanism and the striking mechanism are features that correspond to the "striking mechanism part" according to this invention. Further, the power transmitting mechanism appropriately reduces the speed of torque of the driving motor 211 and transmits it to the hammer bit 219 via the tool holder 237, so that the hammer bit 219 is caused to rotate in its circumferential direction. Specifically, in hammer drill mode, the hammer bit 219 performs striking movement in the axial direction and rotation in the circumferential direction so that a hammer drill operation is performed on a workpiece. In hammering mode, torque transmission of the power transmitting mechanism is interrupted by the clutch. Therefore, the hammer bit 219 performs only the striking movement in the axial direction so that a hammering operation is performed on a workpiece. Further, the driving motor 211 is driven when a user depresses a trigger 209*a* disposed on the handgrip 209.

A vibration-proofing structure for preventing or reducing transmission of vibration from the body 203 to the handgrip 209 designed to be held by a user during hammering or hammer drill operation is now explained with reference to FIGS. 15 to 19. In this embodiment, the handgrip 209 and the outer housing 202 may be formed in one piece, or they may be separately formed and integrally connected to each other. The outer housing 202 is connected to the body 203 via a vibration-proofing compression coil spring 281 such that it can move in the axial direction of the hammer bit 219 with respect to the body 203, and also connected to the body 203 via a plurality of vibration-proofing rubber rings 283 such that it can move in the vertical and lateral directions transverse to the axial direction of the hammer bit 219 with respect to the body 203. The rubber rings 283 and the compression coil spring 281 are features that correspond to the "first elastic element" and the "second elastic element", respectively, according to this invention.

The handgrip 209 is generally D-shaped as viewed from the side and has a grip region 209A extending in the vertical direction transverse to the axial direction of the hammer bit 219, and connecting regions 209B, 209C extending substantially horizontally forward from upper and lower ends of the grip region 209A. Further, front ends of the upper and lower connecting regions 209B, 209C are integrally connected to a rear end of the outer housing 202. As shown in FIG. 15, the compression coil spring 281 is elastically disposed between a front surface of an upper end portion of the outer housing 202 to which the handgrip 209*a* is connected, and a rear surface of a rear upper end portion of the crank housing 207 in the body 203. In this state, the compression coil spring 281 can be expanded and compressed in the axial direction of the hammer bit 119. One end of the compression coil spring 281 is held in contact with a spring receiving part 202*a* on the outer housing 202 and the other end is held in contact with a spring receiving part 207*a* on the crank housing 207. The compression coil spring 281 thus arranged serves to reduce transmission of vibration from the body 203 to the handgrip 209 in the axial direction of the hammer bit 219.

The compression coil spring 281 exerts a forward biasing force on the crank housing 207, and thus the handgrip 209 and the outer housing 202 are subjected to a relatively rearward biasing force. Therefore, as shown in FIG. 15, a stopper ring 282 made of rubber or resin is disposed between an outer front surface 205*a* of the motor housing 205 in the body 203 and a stepped surface 202*b* formed on the inner surface of the outer housing 202 in the radial direction and facing the outer front surface 205*a*. With this construction, an initial positional relation between the outer housing 202 and the body 203 is defined.

Figure 19:
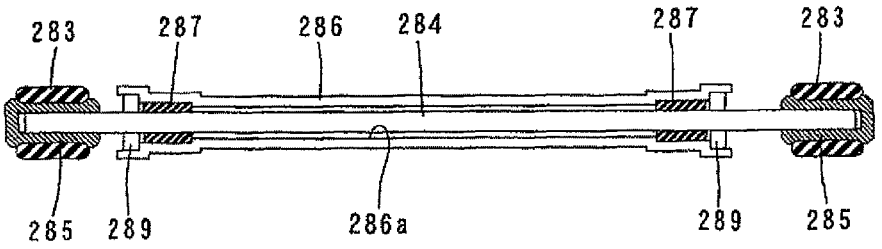
FIG. 19 is a sectional view taken along line in FIG. 17.

As shown in FIGS. 16 to 19, the rubber rings 283 are fitted onto both axial ends of each of elongate pin members 284 and retained via respective rubber ring retainers 285. The pin member 284 is a feature that corresponds to the "rod-like member" according to this invention. Two right and left elongate cylindrical members 286 are disposed on the underside (outer surface) of a bottom plate 207*b* of the crank housing 207 on the opposite sides of the axis of the hammer bit 219 and extend parallel to each other in the axial direction of the hammer bit 219. The right and left cylindrical members 286 may be integrally formed with or fixedly mounted to the crank housing 207. Each of the pin members 284 extends through the associated cylindrical member 286, and as shown in FIG. 19, the pin member 284 is supported at the both ends of the cylindrical member 286 via sliding bearings 287 such that it can slide in the axial direction of the hammer bit 219 with respect to the cylindrical member 286. The both axial ends of the pin member 284 protrude from the cylindrical member 286 to the outside, and the rubber rings 283 are coaxially mounted onto the protruding ends of the pin member 284 via the rubber ring retainers 285. Thus, a total of four front and rear, right and left rubber rings 283 are disposed in a lower region outside the crank housing 207.

As shown in FIG. 15, four cylindrical holding parts 288 are formed in the outer housing 202 and house and hold the four rubber rings 283. Each of the rubber rings 283 is held in surface contact with an inner circumferential surface of the cylindrical holding part 288 and connected to the cylindrical holding part 288 such that it can elastically deform in the radial direction. In this manner, the outer housing 202 is connected to the body 203 via the four rubber rings 283 disposed side by side substantially on the same horizontal plane, in the vicinity of the bottom of the crank housing 207 or substantially in a middle region of the body 203 in the vertical direction, such that it can move in a direction (vertical and lateral directions) transverse to the axial direction of the hammer bit 219 with respect to the body 203.

Further, both axial end surfaces of the pin member 284 (end surfaces of the rubber ring retainers 285) are held in contact with the bottom of the cylindrical holding part 288. Therefore, the outer housing 202 and the pin member 284 are prevented from moving in the axial direction of the hammer bit 219 with respect to each other and thus form an integrated structure. Therefore, the pin member 284 moves in the axial direction of the hammer bit 219 together with the outer housing 202 with respect to the crank housing 207 and serves as a guide rail for guiding the movement of the outer housing 202.

Figure 16:
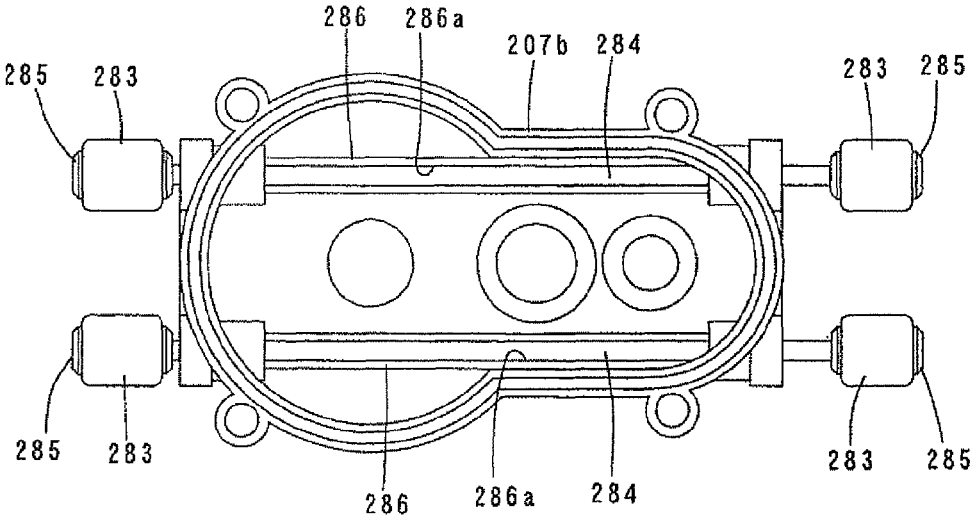
FIG. 16 is a planar view illustrating a bottom plate of a crank housing and a vibration-proofing structure which is provided for the outer housing on the bottom plate.
Figure 17:
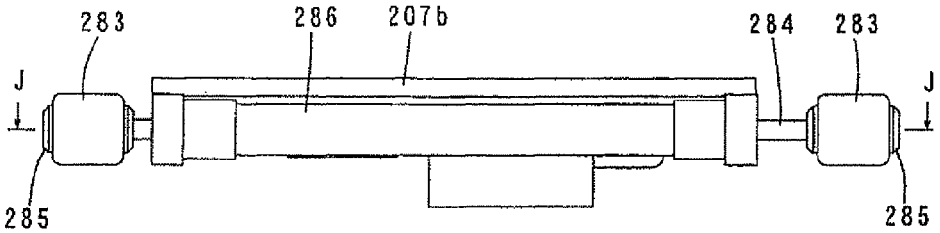
FIG. 17 is a side view of FIG. 16.
Figure 18:
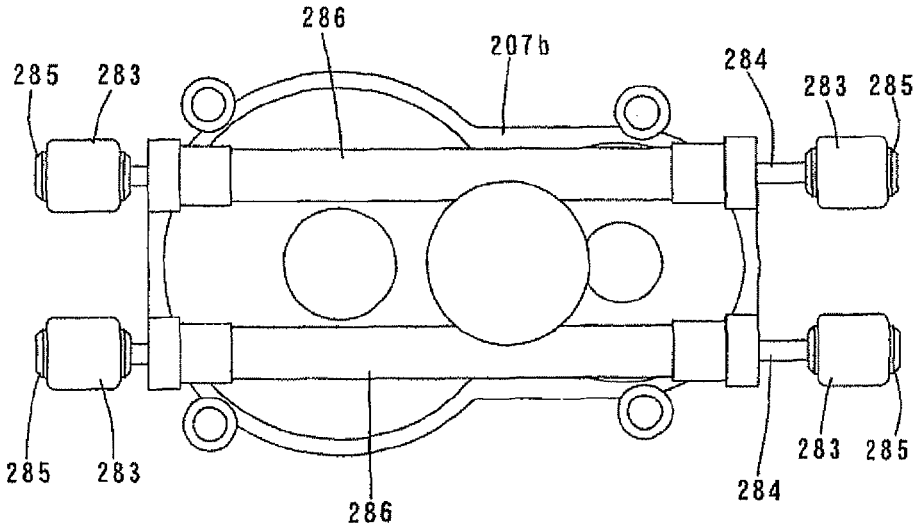
FIG. 18 is a bottom view of FIG. 16.

As shown in FIG. 16, an opening 286*a* is formed in a region of an upper surface of the cylindrical member 286 which faces an inner surface of the bottom plate 207*b* of the crank housing 207 (the inside of the housing), and lubricant (grease) within the crank housing 207 is led into the cylindrical member 286 through the opening 286*a*. Thus, a sliding surface between the pin member 284 and the cylindrical member 286 (the sliding bearing 287) is lubricated with lubricant, so that smoothness of their sliding movement and their durability can be improved. Further, an oil seal 289 for preventing leakage of lubricant is provided on the outer side of the sliding bearing 287.

As shown in FIG. 15, like in the first embodiment, the outer housing 202 for covering the body 203 covers a region of the body 203 other than a lower region of the motor housing 205. Further, parts to be operated by a user, and more specifically, a chuck 249 which is disposed in a front end region of the tool holder 237 in order to removably attach the hammer bit 219 to the tool holder 237, and an operation mode switching dial 247 for switching the operation mode of the hammer bit 219, are exposed from the outer housing 202.

A dynamic vibration reducer 271 is mounted on each of the right and left side surfaces of the crank housing 207. Although not shown, the dynamic vibration reducer 271 has the same construction as the dynamic vibration reducer 171 which is described in the first embodiment. The dynamic vibration reducer 271 forms a vibration reducing mechanism in which the weight connected to the cylindrical element via an elastic element in the form of the biasing spring moves opposite to the direction of vibration which is caused in the body 203 in the axial direction of the hammer bit 219, so that vibration of the body 203 is reduced.

In this embodiment, as described above, the outer housing 202 covering the body 203 is integrally formed with the handgrip 209. Further, the outer housing 202 is connected to the body 203 via the compression coil spring 281 such that it can move in the axial direction of the hammer bit 219 with respect to the body 203, and also connected to the body 203 via the rubber ring 283 such that it can move in the vertical and lateral directions transverse to the axial direction of the hammer bit 219 with respect to the body 203. With such a construction, as for vibration which is caused in the body 203 by striking the hammer bit 219 and transmitted to the outer housing 202 during hammering or hammer drill operation, vibration in the axial direction of the hammer bit 219 is reduced by the compression coil spring 281 and vibration in the vertical and lateral directions transverse to the axial direction of the hammer bit 219 is reduced by the rubber rings 283. In this manner, the outer housing 202 and the handgrip 209 are made proof against vibration in all directions, or in the axial direction of the hammer bit 219 and in the vertical and lateral directions transverse to the axial direction of the hammer bit.

Specifically, according to this embodiment, like in the above-described first embodiment, the handgrip 209 to be held by a user is made proof against vibration in the axial direction of the hammer bit 209 and in a direction transverse to the axial direction, and the rubber ring 283 for preventing vibration in a direction transverse to the axial direction is designed to have a relatively high spring stiffness by increasing its spring constant. With this construction, the handgrip 209 is prevented from wobbling in a direction transverse to the axial direction with respect to the body 203, so that usability can be enhanced.

Further, the rubber ring 283 in this embodiment may be designed to prevent vibration not only in a direction transverse to the axial direction of the hammer bit 219 but also in the axial direction of the hammer bit.

Further, in this embodiment, the pin member 284 is provided on the crank housing 207 and slidably extends through the cylindrical member 286 in the axial direction of the hammer bit 219, and the outer housing 202 moves together with the pin member 284 in the axial direction of the hammer bit 219 with respect to the crank housing 207. Specifically, the pin member 284 serves as a guide rail for guiding the movement of the outer housing 202 with respect to the crank housing 207. Thus, the outer housing 202 can move with respect to the crank housing 207 with stability, so that usability of the impact tool can be improved. Further, with the construction in which lubricant within the crank housing 207 is supplied to the sliding surface between the pin member 284 and the cylindrical member 286, smoothness and durability of the sliding parts can be effectively enhanced.

In the first to third embodiments, the hammer drills 101, 201 are explained as representative examples of the impact tool, but this invention can also be applied to a hammer in which the hammer bits 119, 219 perform only striking movement.

In view of the above-described invention, the following aspects can be provided.

Aspect 1

"The impact tool as defined in any one of claims 2 to 4, comprising a plurality of the first elastic elements which are disposed symmetrically with respect to an axis of the tool bit."

Aspect 2

"The impact tool as defined in claim 3, wherein the first elastic element is held by a cylindrical part formed on at least one of the tool body and the outer shell housing when the split elements are connected to each other."

Aspect 3

"The impact tool as defined in claim 8, wherein the dynamic vibration reducer has a columnar element, a weight which is housed within the cylindrical element and can linearly move in an axial direction of the tool bit, and an elastic element which connects the weight and the cylindrical element, and the first elastic element is disposed on an outer circumferential surface of the cylindrical element and elastically held in contact with an inner surface of the outer shell housing."

Aspect 4

"The impact tool as defined in any one of claims 5 to 7, wherein a plurality of the first elastic elements are disposed side by side on one horizontal plane, in a middle region of the tool body in a vertical direction transverse to the axial direction of the tool bit."

Aspect 5

"The impact tool as defined in claim 6 or 7, wherein lubricant in the tool body is supplied to a sliding part between the rod-like member and the tool body."

DESCRIPTION OF NUMERALS

101 hammer drill (impact tool)
102 outer housing (outer shell housing)
102F front housing part (split element)
102R rear housing part (split element)
103 body (tool body)
105 motor housing
105*a* pin-like protrusion
106 barrel
107 crank housing
107*a* top cover
109 handgrip (handle)
109A grip region
109B upper connecting region
109C lower connecting region
109*a* trigger
111 driving motor (motor)
113 motion converting mechanism (striking mechanism part)
115 striking mechanism (striking mechanism part)
117 power transmitting mechanism
119 hammer bit (tool bit)
121 pivot
123 compression coil spring (second elastic element)
124 dustproof cover
125 columnar element
127 cylindrical member
129 stopper bolt
131 sleeve
133 O-ring (first elastic element)
135 piston
137 tool holder
141 cylinder
141*a* air chamber
143 striker
145 impact bolt
147 operation mode switching dial
149 chuck
151 screw
151*a* front connecting boss
151*b* rear connecting boss
152 screw
153 first elastic rubber (first elastic member)
155 second elastic rubber (first elastic member)
157 third elastic rubber (first elastic member)
159 fourth elastic rubber (first elastic member)
161 cylindrical part
163 cylindrical part
165 cylindrical part
167 engagement part
171 dynamic vibration reducer
172 cylindrical element
173 weight
174 biasing spring
176 fifth elastic rubber (first elastic member)
177 cylindrical part
178 protrusion
201 hammer drill (impact tool)
202 outer housing (outer shell housing)
202*a* spring receiving part
202*b* stepped surface
203 body
205 motor housing
205*a* outer front surface
206 barrel
207 crank housing
207*a* spring receiving part
207*b* bottom plate
209 handgrip (handle)
209A grip region
209B upper connecting region
209C lower connecting region
209*a* trigger
211 driving motor
219 hammer bit (tool bit)
237 tool holder

247 operation mode switching dial
249 chuck
281 compression coil spring (second elastic element)
282 stopper ring
283 rubber ring (first elastic element)
284 pin member (rod-like member)
285 rubber retainer
286 cylindrical member
286*a* opening
287 sliding bearing
288 cylindrical holding part
289 oil seal

The invention claimed is:

1. An impact tool which linearly drives a tool bit in an axial direction of the tool bit to cause the tool bit to perform a predetermined hammering operation, comprising:

a motor, a striking mechanism part that is driven by the motor and causes the tool bit to linearly move, a tool body that houses the motor and the striking mechanism part, an outer shell housing that covers at least part of the tool body, a first elastic element that elastically connects the outer shell housing to the tool body such that the outer shell housing can move in a direction transverse to the axial direction of the tool bit with respect to the tool body, a handle designed to be held by a user, a second elastic element that connects the handle to the outer shell housing such that the handle can move in the axial direction of the tool bit with respect to the tool body, wherein the tool body has a barrel extending in the axial direction of the tool bit, the first elastic element is interveningly disposed between an outer circumferential surface of the barrel and an inner circumferential surface of the outer shell housing which covers the barrel, and the first elastic element positions the outer shell housing in a radial direction with respect to the tool body, and wherein the striking mechanism comprises a motion converting element and a striking element, the striking element is at least partly housed by the barrel of the tool body, a plurality of third elastic elements that can elastically deform in the direction transverse to the axial direction of the tool bit, and a rod-like member which is provided in the tool body and slidably extends through the tool body in the axial direction of the tool bit, wherein:

the outer shell housing is connected to the tool body via at least the plurality of third elastic elements and the second elastic element, the rod-like member serves as a guide rail for guiding movement of the outer shell housing in the axial direction of the tool bit with respect to the tool body, the rod-like member extends in the axial direction of the tool bit and an elastic element of the plurality of third elastic elements is mounted to each end of the rod-like member, and the tool body comprises a first hole that is disposed close to the tool bit and a second hole that is disposed remote from the tool bit in the axial direction of the tool bit, and the rod-like member is provided to penetrate the first and second holes.

2. The impact tool as defined in claim 1, wherein the handle has a grip region extending in a direction transverse to the axial direction of the tool bit and one end of the grip region in an extending direction is connected to the outer shell housing by the second elastic element comprising a mechanical spring.

3. The impact tool as defined in claim 1, wherein the outer shell housing is split into a plurality of split elements in the axial direction of the tool bit and formed by connecting the split elements to each other.

4. The impact tool as defined in claim 1, comprising a dynamic vibration reducer which is provided in the tool body and reduces vibration of the tool body in the axial direction of the tool bit.

5. An impact tool, which linearly drives a tool bit in an axial direction of the tool bit to cause the tool bit to perform a predetermined hammering operation, comprising:

a motor, a striking mechanism part that is driven by the motor and causes the tool bit to linearly move, a tool body that houses the motor and the striking mechanism part, an outer shell housing that covers at least part of the tool body, a handle that is designed to be held by a user and integrally formed on an opposite side of the outer shell housing from the tool bit, a plurality of first elastic elements that can elastically deform in a direction transverse to the axial direction of the tool bit, a second elastic element that can elastically deform in the axial direction of the tool bit, and a rod-like member which is provided in the tool body and slidably extends through the tool body in the axial direction of the tool bit, wherein:

the outer shell housing is connected to the tool body via at least the plurality of first elastic elements and the second elastic element, the rod-like member serves as a guide rail for guiding movement of the outer shell housing in the axial direction of the tool bit with respect to the tool body, the rod-like member extends in the axial direction of the tool bit and a first elastic element of the plurality of first elastic elements is mounted to each end of the rod-like member, and the tool body comprises a first hole that is disposed close to the tool bit and a second hole that is disposed remote from the tool bit in the axial direction of the tool bit, and the rod-like member is provided to penetrate the first and second holes.

6. The impact tool as defined in claim 5, wherein the rod-like member and the outer shell housing are connected to each other via the plurality of first elastic elements.

7. The impact tool as defined in claim 5, comprising a dynamic vibration reducer which is provided in the tool body and reduces vibration of the tool body in the axial direction of the tool bit.

8. The impact tool as defined in claim 5, wherein the striking mechanism comprises a motion converting element and a striking element, and the striking element is at least partly housed by the tool body.

9. An impact tool, which linearly drives a tool bit in an axial direction of the tool bit to cause the tool bit to perform a predetermined hammering operation, comprising:

a motor, a striking mechanism part that is driven by the motor and causes the tool bit to linearly move, a tool body that houses the motor and the striking mechanism part, an outer shell housing that covers at least part of the tool body, a handle that is designed to be held by a user and integrally formed on an opposite side of the outer shell housing from the tool bit, a plurality of first elastic elements that can elastically deform in a direction transverse to the axial direction of the tool bit, a second elastic element that can elastically deform in the axial direction of the tool bit, and a rod-like member which is provided in the tool body and slidably extends through the tool body in the axial direction of the tool bit, wherein:

the outer shell housing is connected to the tool body via at least the plurality of first elastic elements and the second elastic element, the rod-like member serves as a guide rail for guiding movement of the outer shell housing in the axial direction of the tool bit with respect to the tool body, the rod-like member extends in the axial direction of the tool bit and a first elastic element of the plurality of first elastic elements is mounted to each end of the rod-like member, and the rod-like member is provided with two elongate members, and the two elongate members are disposed on opposite sides of the axis of the tool bit to each other.

* * * * *